US005921229A

United States Patent [19]

Blake

[11] Patent Number: 5,921,229

[45] Date of Patent: Jul. 13, 1999

[54] HAND-PORTABLE, LIGHT-WEIGHT COOKER/HEATING DEVICE

[76] Inventor: Michael A Blake, 28 Shirley Street, Orangeville, On., Canada, L9W 2T4

[21] Appl. No.: 08/938,027

[22] Filed: Sep. 19, 1997

Related U.S. Application Data

[63] Continuation-in-part of application No. 08/573,125, Dec. 15, 1995., abandoned

[51] Int. Cl.[6] ..... F24C 15/00

[52] U.S. Cl. ..... 126/275 R; 126/37 B

[58] Field of Search ..... 126/275 R, 37 B, 126/19 M

[56] References Cited

U.S. PATENT DOCUMENTS

| | | | |
|---|---|---|---|
| D. 91,995 | 4/1934 | Fletcher | 126/37 B |
| 101,357 | 3/1870 | McCann | 126/275 R |
| 316,914 | 4/1885 | Ringen . | |
| 343,231 | 6/1886 | Dahmann | 126/275 R |
| 704,300 | 7/1902 | Dahman . | |
| 758,899 | 5/1904 | Dahman . | |
| 1,016,565 | 2/1912 | Huenefeld . | |
| 1,168,857 | 1/1916 | Coes | 126/275 R |
| 1,342,991 | 6/1920 | Erskine | 126/275 R |
| 1,461,280 | 7/1923 | McBride | 126/275 R |
| 1,726,735 | 9/1929 | Firestone | 126/275 R |
| 1,907,414 | 5/1933 | Antrim . | |
| 2,057,373 | 10/1936 | Dukes . | |
| 2,072,036 | 2/1937 | Horsman . | |
| 2,077,687 | 4/1937 | Goldbert et al. | 126/275 R |
| 2,077,777 | 4/1937 | Stanley . | |
| 2,189,875 | 2/1940 | Bartlebaugh . | |
| 2,358,034 | 9/1944 | Schweller et al. | 126/275 R |
| 2,501,935 | 3/1950 | Fader . | |
| 3,064,554 | 11/1962 | Lamb | 126/37 B |
| 3,308,807 | 3/1967 | Little et al. . | |
| 3,354,878 | 11/1967 | Balls . | |
| 3,867,922 | 2/1975 | Dahlquist | 126/274 |
| 4,051,837 | 10/1977 | Norman | 126/275 R |
| 5,101,805 | 4/1992 | Noh | 126/273 R |

OTHER PUBLICATIONS

Procampo–Portable Oven, Canadian Gas Association.
Blakes "Procampo", Portable Oven.

*Primary Examiner*—Carl D. Price
*Attorney, Agent, or Firm*—D. W. Eggins

[57] ABSTRACT

An all-metal, hand-portable, light-weight heating device serves as a self-contained oven, as a stove, or as a space heater. The box-like device comprises hollow sheet-metal back, side and top walls and door. A fully enclosed heater chamber beneath the oven enclosure includes a removable, slide-in top closure plate, which channels hot air to the interior of the hollow walls when used as an oven or space heater; removal of the closure plate enables use of the device as a stove. A second embodiment has a foldable stove top hinged to the side of the device. The preferred material is sheet aluminum. A portable gas bottle can be used as the fuel supply. Excess secondary air is available, induced by the operation of the gas burner. This induced flow of cool air creates a high thermal gradient between the inner and the outer heated wall surfaces, so that the outer surfaces of the device operate at a safe, non-searing temperature. The device can be used for camping, cook-outs, or for emergency situations, or for household use as a regular oven or stove in third world communities.

10 Claims, 3 Drawing Sheets

17
12
29
42
22
40
21
35
14
18
22
16
28

HAND-PORTABLE, LIGHT-WEIGHT COOKER/HEATING DEVICE

CROSS REFERENCE TO RELATED APPLICATIONS

This application is a Continuation-in-part of application Ser. No. 08/573,125 filed Dec. 15, 1995, now abandoned.

BACKGROUND OF THE INVENTION

1. Field of the Invention

This invention is directed to a heating device, and in particular to a self-contained multi-purpose, hand portable heating device that can be used as a cooling stove, as an oven, or as a spaceheater.

2. Description of the Prior Art

There is a long history of efforts that have been made in the past to provide portable cooking apparatus.

Included in this are the following United States patents:

Dahman: U.S. Pat. No. 758,899 May 1904, which shows a knock-down oven having hollow walls for purposes of insulation, held by removable snap fasteners; there appears to be no provision for air circulation through the hollow walls;

McBride: U.S. Pat. No. 1,461,280July 1923, which shows a removable oven having hollow walls, for use over a stove burner, without any provision being made for secondary air, necessary for obtaining an effective thermal gradient between internal and external oven surfaces, for safety purposes;

Dukes: U.S. Pat. No. 2,057,373 Oct. 1936, which shows a portable oven having an alcohol burner as its heat supply;

Horsman: U.S. Pat. No. 2,072,036 Feb. 1937, which shows a portable, cannister-like bake-oven for use with a gas or electric stove;

Stanely: U.S. Pat. No. 2,077,777 Apr. 1937, which shows a hollow wall oven for use upon an oil, gas or electric stove;

Bartlebaugh: U.S. Pat. No. 2,189,875 Feb. 1940, which shows a portable, hollow walled oven having a complex circulatory air flow;

Fader: U.S. Pat. No. 2,501,935 Mar. 1950, which shows a portable sheet metal oven for use over an external gas or oil burner;

Little et al: U.S. Pat. No. 3,308,807 Mar. 1967, which shows the well known Coleman foldable oven for use over a camp stove;

Balls: U.S. Pat. No. 3,354,878 Nov. 1967, which shows a portable range incorporating a firebox and a variable thickness oven bottom;

Dahlquist: U.S. Pat. No. 3,867,922 Feb. 1975, which shows a dissassembleable portable oven, secured by threaded rods and wing-nuts;

Norman: U.S. Pat. No. 4,051,837 Oct. 1977, which shows an outer and a separate inner casing for use upon a camp stove;

Noh: U.S. Pat. No. 5,101,805 Apr. 1992, which shows a gas cooker having a mechanism permitting use as an oven or as a grill.

In considering and comparing portable type ranges and ovens with orthodox kitchen appliances, it should be born in mind that whereas the regular appliances include internal insulation, so as to lower the sides and back temperatures sufficiently to enable the appliance to be sandwiched safely against adjoining cupboards, the portable type of device is not so protected, mainly on the bases of weight, cost and size, and thereby, in the foregoing prior art embodiments, these operate at thigh surface temperatures, and require significant peripheral safety clearances to reduce the danger of fire or injury.

While many of the appearance characteristics of the present invention can be seen in the foregoing prior art, there is no prior teaching to lead one to provide the safety characteristics, particularly a relatively cool outer casing, that give the present invention its unexpected characteristics and capabilities.

SUMMARY OF THE INVENTION

It has been found that hot gas and cool outside air can be passed from a heating chamber into a hollow wall structure such that one surface of the hollow wall structure is heated to a high temperature, while the adjacent other wall suface is maintained at a substantially lower temperature, thereby establishing a stable, high thermal gradient between adjacent portions of a hollow wall. The present invention provides a self-contained, hand-portable light-weight, multi-purpose heating device that may be used as a self-contained oven, as a stove, and as a spaceheater. The present device has hollow walls, which include the top of the box-like oven structure, that are preferably of sheet aluminum, both for lightness and for high heat conductivity.

The hollow walls have internal connecting passageways, forming mutually balanced convectional flow paths extending upwards through the walls, and extending from below the oven enclosure to an outlet zone located in the top wall outer surface. Beneath the oven there is an enclosed heating chamber, which contains the inlets to the wall flow paths, and the heat source, preferably a gas burner. Also, copious air inlets are provided, referred to below.

Four supporting feet extend beneath the heating chamber, maintaining the bottom of the heating chamber clear of the supporting surface, to enable safe use of the device out of doors, even upon grassy surfaces.

Other forms of heating may also be utilized, including electrical elements, provided that the secondary air supply is maintained, to assure inductive flow cooling of the walls.

The heating chamber is amply provided with air inlet vents, for the unimpeded ingress of combustion air and secondary cooling air. A withdrawable closure sheet substantially isolates the heating chamber from the oven interior, and when inserted in position serves to guide the hot gases and the induced flow of secondary, cooling air to the inlets of the interior convection flow paths, inside the walls.

It appears probable that the hot combustion gases initially flow upwardly over the enclosed vertical surfaces of the inner walls, while the induced flow of secondary, cooling air mostly blankets the intervening interior space to the vertical outer wall portions, thereby creating a steep temperature gradient, and maintains relatively cool the outer wall surfaces.

As a consequence the external surface temperature of the device is normally about one quarter that of the interior, oven walls. Thus, at extreme oven temperatures as high as 600 F. degrees the exterior surfaces do not normally exceed about 150 F.; i.e. it does not char paper or reach a flesh-searing heat; and at normal oven cooking temperatures, in the 400 F range, the exterior wall temperature is about 120 F., i.e. it can be briefly touched, at the limit of comfort.

When used as a stove, having the door open and the closure sheet removed, the hot gases pass directly from the heating chamber up into the oven space, and exit through the open door, substantially by-passing the interior-wall passages, and leaving the exterior surfaces of the device quite cool. The provision of excess air ensures extremely clean burning, normally without the generation of carbon monoxide.

Thus there is provided a heating device incorporating a heat generating means; a box-like enclosure having side, back and top hollow walls and a door; the walls and top having internal connecting air vent passages for upward passage of heated gases therethrough, the top wall outer surface being vented to atmosphere; a heating chamber ventilated to atmosphere located beneath the enclosure and separated therefrom by a closure sheet; the heating device and vent inlets to the air vent passages being located within the heating chamber whereby, in use, substantially balanced, uni-directional conventional flow of hot air and cooling air is obtained through the walls and the top of the device, to provide a steep thermal gradient, and a relatively low outside surface temperature.

The present invention thus provides a light-weight hand-portable, multi-purpose heating device comprising: a box-like enclosed structure having an access door giving access to an upper oven chamber portion of the device; a heating chamber beneath the upper chamber; the peripheral walls of the heating chamber having hollow upper wall portions, with apertures providing air flow access from within the heating chamber to the interior of the hollow walls, and lower wall portions perforated to outside atmosphere, to admit excess air within the heating chamber; a heating means located within the heating chamber; and a closure plate substantially separating the upper chamber from the heating chamber and serving in use to deflect hot gas in heating relation and induced air flow in cooling relation into the hollow walls, to establish a high thermal gradient therein, wherein the inner wall surfaces of the hollow walls are at a high temperature, and the outer wall surfaces of the hollow walls are at a substantially cooler temperature. The BTU rating of the device depends upon the rated flow capacity of the gas admission orifice, such that by selecting an orifice of unduly large BTU capacity the desirable safe external temperatures may be exceeded.

For both safety and comfort the device is best located to provide acceptable safety clearances, such as about three inches peripheral clearance.

In use, the radiant and convectional heat generated by the device will heat the local environment.

On grounds of safety, an adequate supply of outside fresh air should always be assured, when using the device in an enclosed space such as indoors or in a trailer, to provide about 36 square inches of opening to outside atmosphere. Also, a chimney for hot gases is adviseable for indoor use, due to the carbon dioxide being generated.

The structure has supporting foot means attached to the side walls of the device.

A second embodiment of the subject device may incorporate with the above described cube-like device an additional stove portion attached to the oven assembly. The attachment may be by hingeing to one side of the oven assembly, to permit transportation in a folded condition; or by lug-and-slot attachment, for easy removal and stowage. In the case of the preferred, gas heated device, the auxiliary stove portion has a second gas ring, which is readily connected to the gas supply of the oven, prefereably with independent shut-off, in addition to the respective regulating valve.

In use as a range, having the door in a lowered position gives unhindered access to the interior of the device, and a removable grill mesh provides support for cooling and heating utensils, such as kettles, saucepans and fry-pans in direct contact with the burner flame. In such use, the excess heated air and exhaust gases tend to leave the interior of the device primarily by way of the open door, together with steam and other vapour, so that the temperature of the outer casing surface remains comparatively low, and little air flow occurs in the walls.

For use as an oven, the bottom closure sheet is inserted in superposed relation with the burner, in virtual sealing relation with the oven, to enclose the heating chamber beneath the oven. There the available copious supply of secondary air ensures complete combustion of the fuel within the heating chamber, while promoting the induced flow of cooling air over the exterior wall surfaces.

The closure sheet serves as a baffle and is heated directly by the burner, thereby providing radiant heat to the oven.

The hot combustion gases, together with a significant volume of induced secondary air are guided by the closure sheet to the adjoining air passage inlets, which are located high up within the heating chamber.

It appears that the hot gases are in substantially stratified relation with the induced flow of outside cool air, whereby a high thermal gradient is established.

The gases pass through the respective walls in mutually balanced flow relation to the exhaust vent located in the top outer surface of the oven.

Use of the device in a totally enclosed area, or one with inadequate fresh air supply is not advocated. In such instances, the use of a chimney to conduct away the oven and heater hot exit gases is strongly recommended, to avoid build-up of carbon dioxide. Despite such recommended exhausting of the hot combustion and secondary air, the device retains a relatively high efficiency, both as an oven and as a stove.

It will be understood that the device may be used with piped natural gas; bottled propane or natural gas, or other suitable combustible gas sources, while an electrical heating element may also be used.

In an embodiment featuring the oven, having approximate dimensions of 17-inches width, by 13-inches depth, by 18-inches height, and made of 18-gauge aluminum sheeting, the device weighs 16-lbs and is readily hand-carried by an average adult. The second embodiment with the added side-burner increases the total weight by 2-lbs.

BRIEF DESCRIPTION OF THE DRAWINGS

Certain embodiments of the invention are described by way of illustration, without limitation of the invention thereto other than as set forth in the accompanying claims, reference being made to the accompanying drawings, wherein;

DETAILED DESCRIPTION OF THE INVENTION

Figure 1:
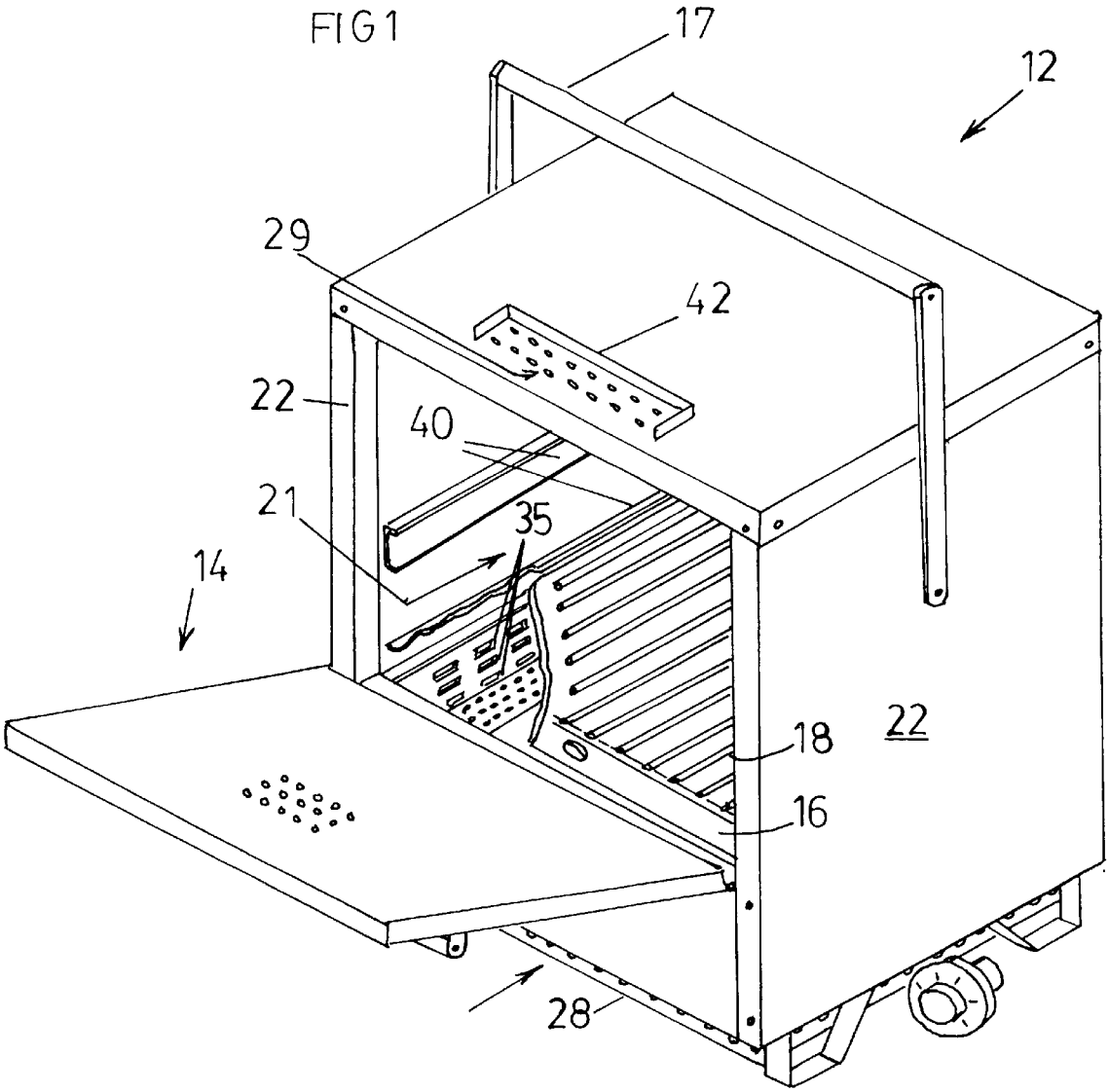
FIG. 1 is a perspective view from above, in partial section of a heating device according to the present invention, in its oven mode, the door being shown open.

Referring to FIG. 1, the "cube-like" heating device 12 is shown, in its "oven" configuration, and with the door 14 in an almost fully opened position. Corner portions of the closure plate 16 and rack 18 are deleted, to reveal interior details of the heating chamber 20.

Figure 2:
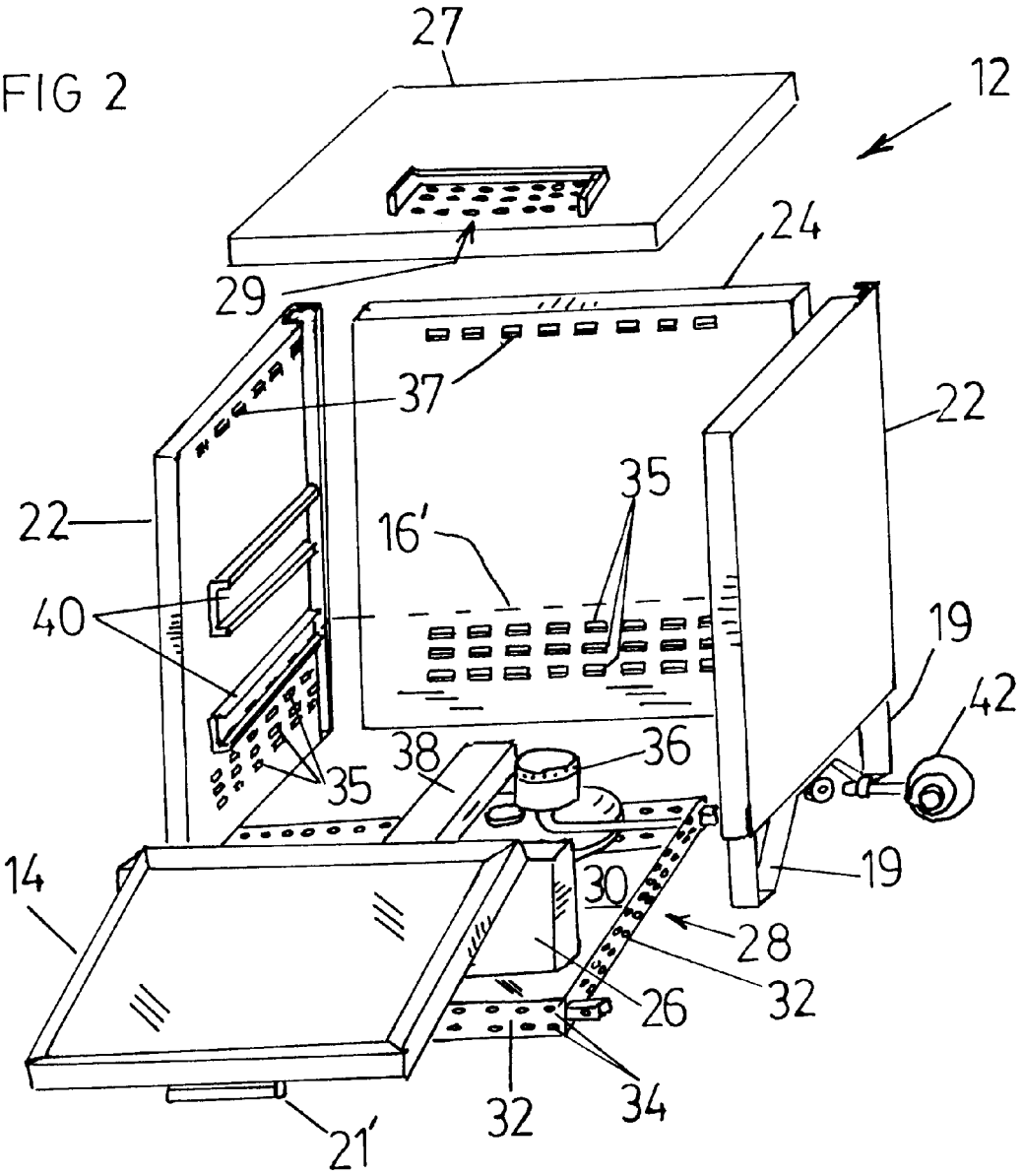
FIG. 2 is a front perspective view from off-center of the subject device, having the elements thereof in exploded relation; and, FIG. 3 is a front perspective view of the embodiment including an auxiliary side stove.

Referring also to FIG. 2, the device 12 has hollow side walls 22 and rear wall 24, a front wall portion 26 with the door 14 hinged thereto, and a hollow top 27.

Feet 19 attached to the side walls 22 support the device 12 clear of the surface upon which it stands.

A carrying handle 17 is pivotally secured to the side walls 22.

The removable closure plate 16 serves to separate the heating chamber 20 from the oven space 21 above.

In FIG. 2 the broken line 16' indicates the position occupied by the closure plate 16, when installed.

A lower portion of the heating chamber 20 is in the form of a tray 28, having an imperforate bottom 30 and perimeter sidewalls 32 perforated with secondary air apertures 34. The upper portion of the heating chamber 20, lying below the line 16', is bounded by the front wall portion 26 and lower portions of the sidewalls 22 and rear wall 24. As stated above, the closure plate 16 when in place substantially separates the heating chamber 20 from the oven space 21.

The lower portions of the hollow sidewalls 22 and rear wall 24 that are located within the heating chamber 20 are heavily perforated with three rows of inlet vents 35, for the passage of combustion gases and secondary air flow induced through the apertures 34. The hollow walls 22, 24 interconnect with the interior of the top 27 by way of vents 37, to provide substantially evenly distributed gas flow therein.

Figure 3:
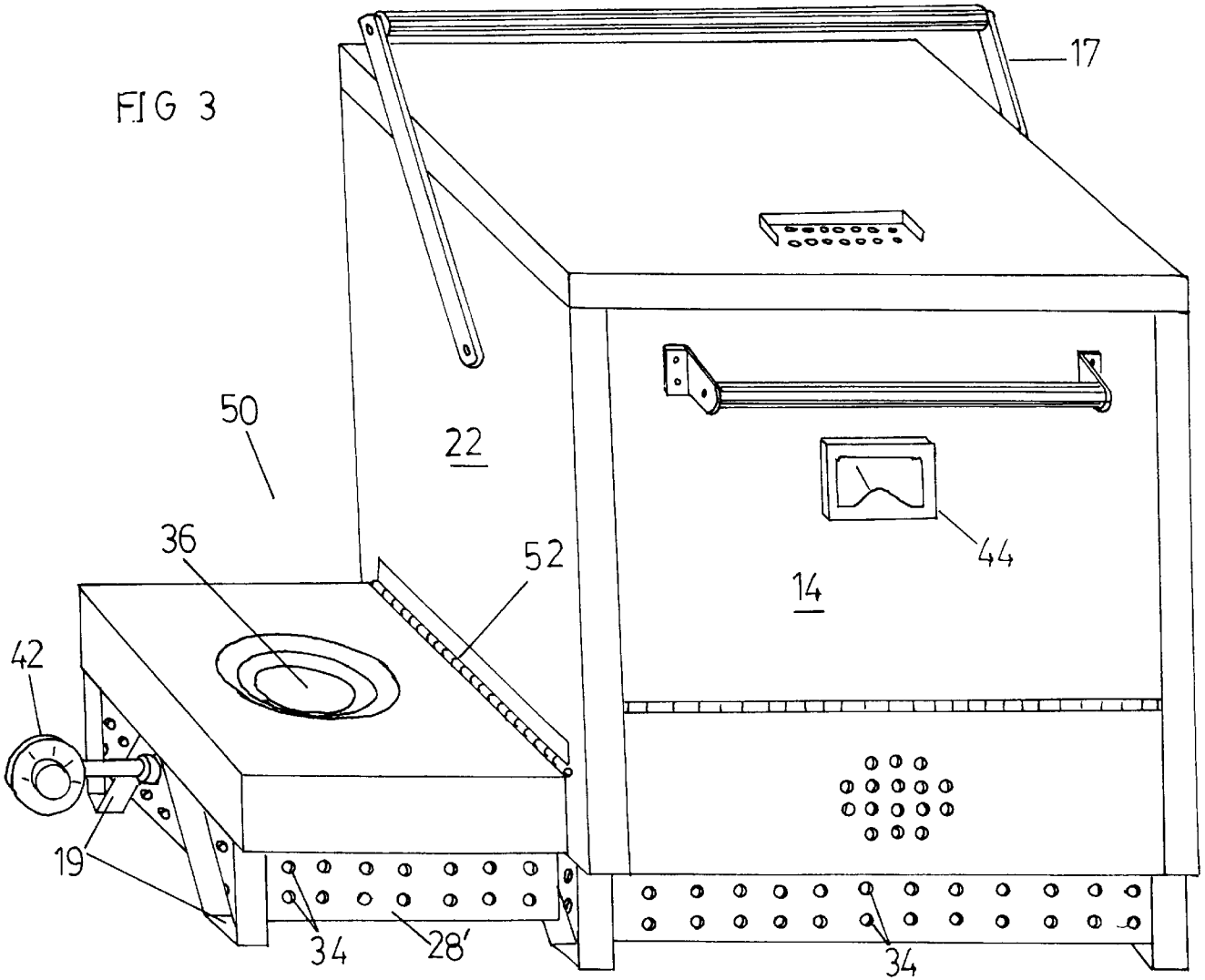

The door 14 has a handle 21', and a thermometer 44 is set in the front face of the door 14 (see FIG. 3).

The sheet metal walls of the device are secured by rivets.

Referring particularly to FIG. 2, a gas burner 36 is mounted upon a support bar 38, attached to the front wall 26 and back wall 24.

A control valve 42 connected to the burner 36 may be connected by a flexible line to a gas bottle (not shown).

The side walls 22 each has a pair of side brackets 40 of wide U-section, to provide four rack support ledges on each wall, the lower one of which ledges supports the closure plate 16, when it is slidably installed in the device 12.

The hollow top 27 (FIG. 1) has a vent 29 comprising a number of apertures in its upper surface, with a protective ledge 42 to prevent accidental blockage. The operation of burner 36 causes the upward passage of combustion gases which induces a significant secondary air flow through the inlet apertures 34.

The closure plate 16 deflects the gas flows outwardly to the wall apertures 35. Thermal stratification appears to produce stratified flow within the hollow walls 22, 24, such that an extremely steep thermal gradient exists wherein the surfaces of the inner wall portions are maintained at a high temperature, while the surfaces of the outer wall portions are consistently much cooler. The gases exit to atmosphere by way of the outlet vent 29 in the top 27.

Referring to FIG. 3, a supplemental stove portion 50 is shown hinged by hinge 52 to a sidewall 22. The stove portion 50 includes a second gas burner 36, equipped with its own control valve 42, and connected to a gas supply by way of a flexible connection (not shown), as above described.

The stove portion 50 may be secured by tongue and slot connection to the sidewall 22, thus enabling its detachment and stowage within the oven space 21, for easy transportation. The air supply to the underside of the stove 50 is similar to that of the device 12, having a tray 28', the imperforate bottom of which forms a heat shield, for safety purposes, to permit safe usage under most environmental circumstances. The fet 19 support the underside of the stove 50 clear of the supporting surface.

In addition to the use of gas in bottled or other form as fuel, the use of a naphtha gas generator of the well-known Coleman (Trademark( type is also possible.

The provision of a simple chimney secured over the vent 29 by way of simple slot-and-tag provisions is contemplated. For purposes of lightness, low cost, thermal characteristics, non-oxidation or carbonization, the use of aluminum sheeting for the major surfaces is preferred. Sheet tin may also prove satisfactory.

COMMERCIAL UTILITY

A widespread market for this new product is envisaged, including recreational use such as camping and cook-outs; domestic complementary cooking, and emergency cooking and supplemental, incidental heating in case of disaster such as earthquakes, war etc; Also, for use in fire-fighter camps, and for military use.

I claim:

1. A light-weight hand-portable, multi-purpose heating device comprising: a boxlike enclosed structure with a carrying handle, the structure comprising an uninsulated sheet metal structure, having inner and outer wall members of sheet metal that form hollow side, back and top wall panels of an oven chamber said side wall panels and said top wall panel having apertures in mutually connecting relation, to permit passage of fluid through the interior of said panels; an opening in the outer wall member of said top wall panel connecting said hollow connected panels to atmosphere; said oven chamber having a front access, and a door to selectively enclose said chamber; a heating area below said door, including lower portions of said wall panels, and a closure plate supported by said side walls and located in substantially isolating relation with said oven chamber, said heating area having apertures in said panel inner wall members providing air flow access from within the heating area to the interior of the hollow wall panels; and lower wall portions of said heating area being perforated to outside atmosphere, to admit excess air within the heating area; a heating means located within the heating area; said closure plate serving in use to deflect hot gas in heating relation and induced air flow in cooling relation into said hollow wall panels, to establish a high thermal gradient therein, wherein said inner wall members of said hollow wall panels are heated to a high temperature, and the outer wall members of said hollow wall panels are maintained at a substantially lower temperature as a consequence of said induced cooling air flow.

2. The heating device as set forth in claim 1, wherein said side panels have support brackets on which said closure plate is slideably mounted, said closure plate being located adjacent said chamber access, and being withdrawable through said access, to expose the interior of said oven chamber directly to said heating area, enabling use of said device, with said door in an open position, as a stove.

3. The heating device as set forth in claim 1, wherein said heating means is a burner.

4. The heating device as set forth in claim 1, wherein said heating area has a reflective floor portion as a heat shield for the device.

5. The heating device as set forth in claim 4, including supporting foot means extending below said reflective floor portion, to raise heated portions of the device clear of a supporting surface.

6. The heating device as set forth in claim 4, said hollow wall panels having convectional heat flow passages of substantially equal length extending from said heating area to said top panel apertures.

7. The heating device as set forth in claim 1, in combination with an adjoining stove, secured to a said side wall panel of the device.

8. The heating combination as set forth in claim 7, said adjoining stove having a gas heater.

9. The heating combination as set forth in claim 7, wherein said adjoining stove is hinged to said side wall panel of the device, permitting folding of the combination to facilitate its transportation.

10. The heating combination as set forth in claim 7, wherein said adjoining stove is detachably secured to said side wall panel.

* * * * *